US006189812B1

(12) United States Patent
Buridant

(10) Patent No.: US 6,189,812 B1
(45) Date of Patent: Feb. 20, 2001

(54) WELDED OR NESTED SHEET METAL NOZZLE FOR INJECTION PULVERIZED COAL FOR THERMAL POWER PLANT BOILERS

(75) Inventor: Daniel Buridant, Massy (FR)

(73) Assignee: ABB Alstom Power Combustion, Velizy-Villacoublay (FR)

( * ) Notice: Under 35 U.S.C. 154(b), the term of this patent shall be extended for 0 days.

(21) Appl. No.: 09/496,612

(22) Filed: Feb. 2, 2000

(30) Foreign Application Priority Data

Mar. 30, 1999 (FR) ..... 99 03961

(51) Int. Cl.[7] ..... F23D 11/10

(52) U.S. Cl. ..... 239/423; 239/587.6; 239/590; 110/263; 110/104 B

(58) Field of Search ..... 239/587.6, 587.5, 239/590, 591, 590.5, 423, 424, 424.5, 552, 553, 553.5, 498, 518, 290, 299; 110/104 B, 265, 263, 297, 347; 431/8, 10, 12; 29/890.142; 122/333

(56) References Cited

U.S. PATENT DOCUMENTS 3,823,875 7/1974 Bauer et al. .
4,356,975 * 11/1982 Chadshay ..... 239/424.5
5,215,259 6/1993 Wark .
5,662,464 * 9/1997 LaRose et al. ..... 431/8
6,089,171 * 7/2000 Fong et al. ..... 110/263

FOREIGN PATENT DOCUMENTS 2 689 211 A1 10/1993 (FR) .
2 240 619 8/1991 (GB) .

* cited by examiner

*Primary Examiner*—Lisa Ann Douglas
(74) *Attorney, Agent, or Firm*—Sughrue, Mion, Zinn Macpeak & Seas, PLLC

(57) ABSTRACT

A nozzle for injecting pulverized coal into the combustion chamber of a thermal power plant boiler includes a first metal housing and a second metal housing surrounding the first housing and defining with it an annular space through which passes a secondary airflow. The first housing channels a primary airflow mixed with pulverized coal. The interior of the first housing is divided by refractory steel splitter plates fixed into the lateral faces thereof by nesting them therein and immobilizing them by way of keys. The second housing is fixed to the first housing by lugs disposed around the top and bottom faces of the first housing. Each housing is made up of two half-shells made from refractory steel plate bent to shape and welded.

2 Claims, 2 Drawing Sheets

WELDED OR NESTED SHEET METAL NOZZLE FOR INJECTION PULVERIZED COAL FOR THERMAL POWER PLANT BOILERS

BACKGROUND OF THE INVENTION

1. Field of the Invention

The invention relates to an aimable nozzle for injecting pulverized coal into the combustion chamber of a thermal power plant boiler, the nozzle including a first metal housing in the shape of a truncated prism having a top face, a bottom face and two lateral faces, a second metal housing in the shape of a truncated prism coaxially surrounding the first housing and defining therewith an annular space through which passes a flow of secondary air, and two pivots for rotation about an axis perpendicular to the lateral faces of the first housing, wherein the first housing channels a flow of primary air mixed with pulverized coal, the housings are fastened to each other and the interior of the first housing is divided by parallel refractory steel splitter plates perpendicular to the lateral faces of the first housing.

2. Description of the Prior Art

As is well known in the art, this type of nozzle is designed to be fitted to a pulverized coal burner mounted on the walls of a combustion chamber of a thermal power plant boiler, between an ashbox and heat exchangers.

It directs pulverized coal mixed with primary air into the combustion chamber. The nozzle is aimable so that it can be inclined in a vertical plane so that the air can be directed into an area of the combustion chamber at a greater or lesser distance from the screens, in order to adjust the heating power of the boiler.

Until now the first housing has been made in one piece by casting it in refractory steel, the second housing has been made from refractory steel plate bent to shape and welded and the splitter plates inside the first housing have been welded to its lateral faces. A nozzle of this kind is exposed to very high thermal stresses. In use, the temperature in front of the nozzle (at the face of the nozzle through which the primary and secondary airflows exit) can be as high as 900° C. to 1000° C., but the temperature is only 200° C. to 300° C. at the rear and the depth is only around 400 mm. Because of radiation phenomena inside the combustion chamber, areas in front of the nozzle can be exposed to high but different temperatures. It has been noticed that these high thermal stresses lead to deformation of the component parts of the nozzle, cracks in the cast components and ruptures of the weld between the splitter plates and the lateral faces of the first housing.

The object of the invention is to propose an aimable nozzle for injecting pulverized coal into the combustion chamber of a thermal power plant boiler which has improved resistance to these thermal stresses.

The basic idea of the invention is a nozzle consisting of welded or nested plates.

SUMMARY OF THE INVENTION

The invention provides an aimable nozzle for injecting pulverized coal into the combustion chamber of a thermal power plant boiler, the nozzle including a first metal housing in the shape of a truncated prism having a top face, a bottom face and two lateral faces, a second metal housing in the shape of a truncated prism coaxially surrounding the first housing and defining therewith an annular space through which passes a flow of secondary air, and two pivots for rotation about an axis perpendicular to the lateral faces of the first housing, wherein the first housing channels a flow of primary air mixed with pulverized coal, the housings are fastened to each other and the interior of the first housing is divided by parallel refractory steel splitter plates perpendicular to the lateral faces of the first housing, and wherein:

- the splitter plates are fixed to the lateral faces of the first housing by nesting their ends in openings provided in the lateral faces and the ends of the plates pass through the openings to receive immobilizing keys disposed in the annular space, allowing each splitter plate some play in a direction perpendicular to the lateral faces of the first housing;
- the second housing is fixed to the first housing by lugs disposed on the top face and the bottom face of the first housing and in the space between the housings;
- the first housing is made up of two half-shells made from refractory steel plate bent to shape and welded together in a median transverse plane parallel to the lateral faces of the first housing, and the second housing is made up of two half-shells made from refractory steel plate bent to shape and welded to each other in a median transverse plane perpendicular to the lateral faces of the first housing; and
- the pivots are welded to the lateral faces of the first housing and pass without contact through the second housing by means of orifices provided therein.

One embodiment of the invention is described in detail hereinafter and shown in the drawings.

DETAILED DESCRIPTION OF THE PREFERRED EMBODIMENT

Figure 1:
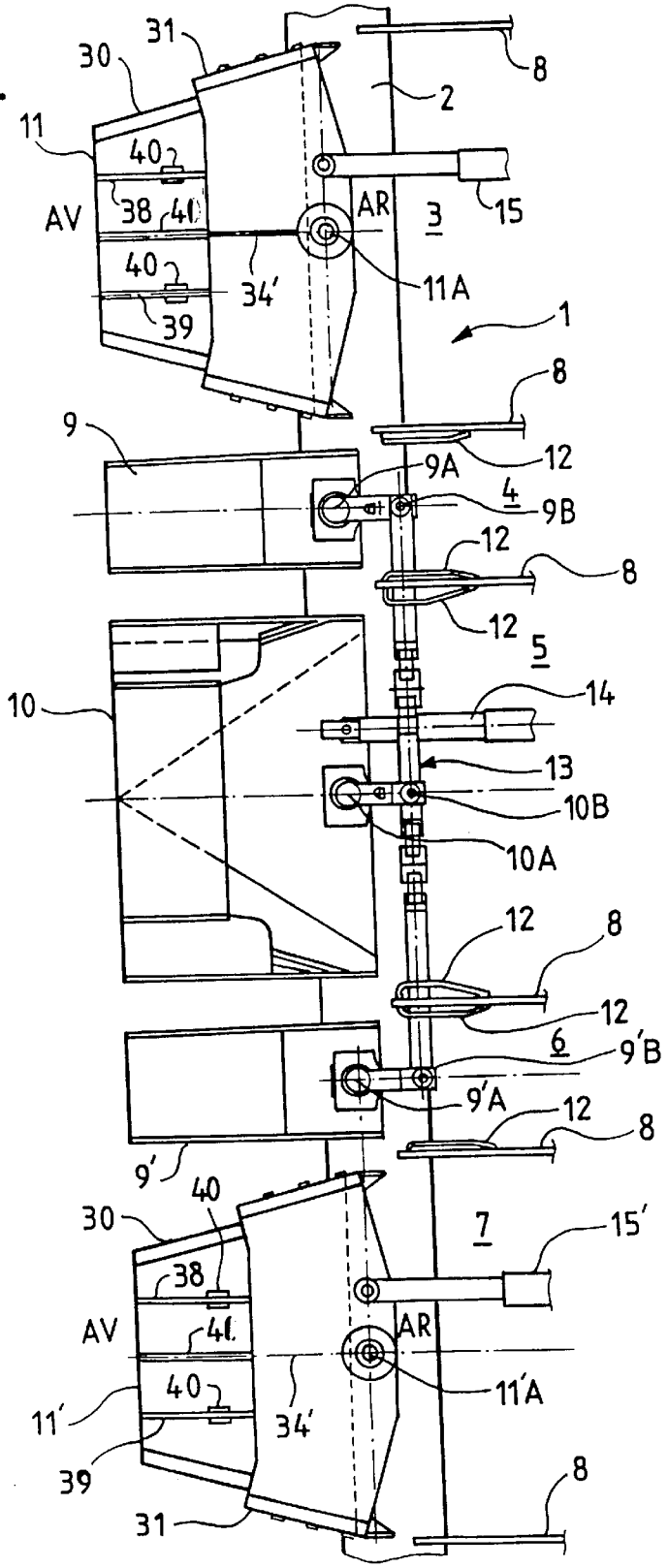
FIG. 1 is a highly schematic profile view in elevation of part of a burner casing fitted to the combustion chamber of a thermal power plant boiler and including aimable nozzles for injecting pulverized coal.

FIG. 1 shows part of a burner casing 1 which is fixed to angle irons 2 of a combustion chamber of a thermal power plant boiler. The casing is vertical when mounted in the combustion chamber of the boiler, as shown in FIG. 1.

The casing 1 includes a series of compartments 3, 4, 5, 6, 7 which are open toward the inside of the combustion chamber and through which air is fed into the interior of the combustion chamber, the cross section of each compartment being substantially rectangular. Two adjacent compartments are separated by a plate 8 lying in a horizontal plane. The compartments of the casing are closed on the side external to the combustion chamber by registers (not shown).

An aimable nozzle is disposed at the opening (on the combustion chamber side) of each compartment to channel and direct air toward the interior of the combustion chamber.

As shown in FIG. 1, the compartments are different sizes depending on whether they receive a simple secondary air nozzle like the nozzles 9, 9' or a fuel oil burner nozzle like the nozzle 10 or a pulverized coal burner nozzle like the nozzles 11, 11'.

In the arrangement shown in FIG. 1, the nozzle 10 of a fuel oil burner is adjacent two simple secondary air nozzles 9, 9'.

Each nozzle 9, 9', 10, 11, 11' can be rotated about a respective horizontal axis 9A, 9'A, 10A, 11A, 11'A in order to incline it in a vertical plane to direct air in a particular direction toward the center of the combustion chamber, between the top and bottom of the combustion chamber.

The gap between the nozzles in the casing is imposed by the operating characteristics of the combustion chamber. It is generally small because it is always a requirement to concentrate the burners to obtain the greatest possible heating power. Also, the nozzles practically shut off the openings of the compartments to enable fine adjustment of the draft and the gap left by a nozzle in the opening of a compartment can if necessary be filled in with wedges 12.

Note that in the burner casing arrangement shown in FIG. 1 the nozzles 9, 9' and 10 and the fuel oil burner are mounted on and demounted from the casing from inside the combustion chamber but the nozzles 11, 11', each of which is fastened to a pulverized coal burner, are mounted on and demounted from the casing from outside the combustion chamber.

The mechanism for inclining the nozzles 9, 9' and 10 includes a vertical link 13 parallel to the casing and common to the three adjacent nozzles. The link 13 connects the pivots 9B, 9'B, 10B (which are offset from the nozzle rotation axes) of the respective nozzles 9, 9', 10 so that inclining any of the three nozzles 9, 9' or 10 simultaneously inclines the other two nozzles by the same amount.

FIG. 1 shows that the pivots for maneuvering the nozzles 9, 9', 10 are disposed at the ends of lever arms each of which rotates at the other end about the rotation axis 9A, 9'A, 10A of the corresponding nozzle 9, 9', 10 and rotation of which in the upward or downward direction drives movement of the corresponding nozzle in the same direction. For example, moving the actuator link 14 articulated to the nozzle 10 substantially horizontally in translation to incline the nozzle 10 inclines all three nozzles 9, 9', 10. Each nozzle 11 and 11' is inclined by its own actuator link 15, 15'.

Figure 2:
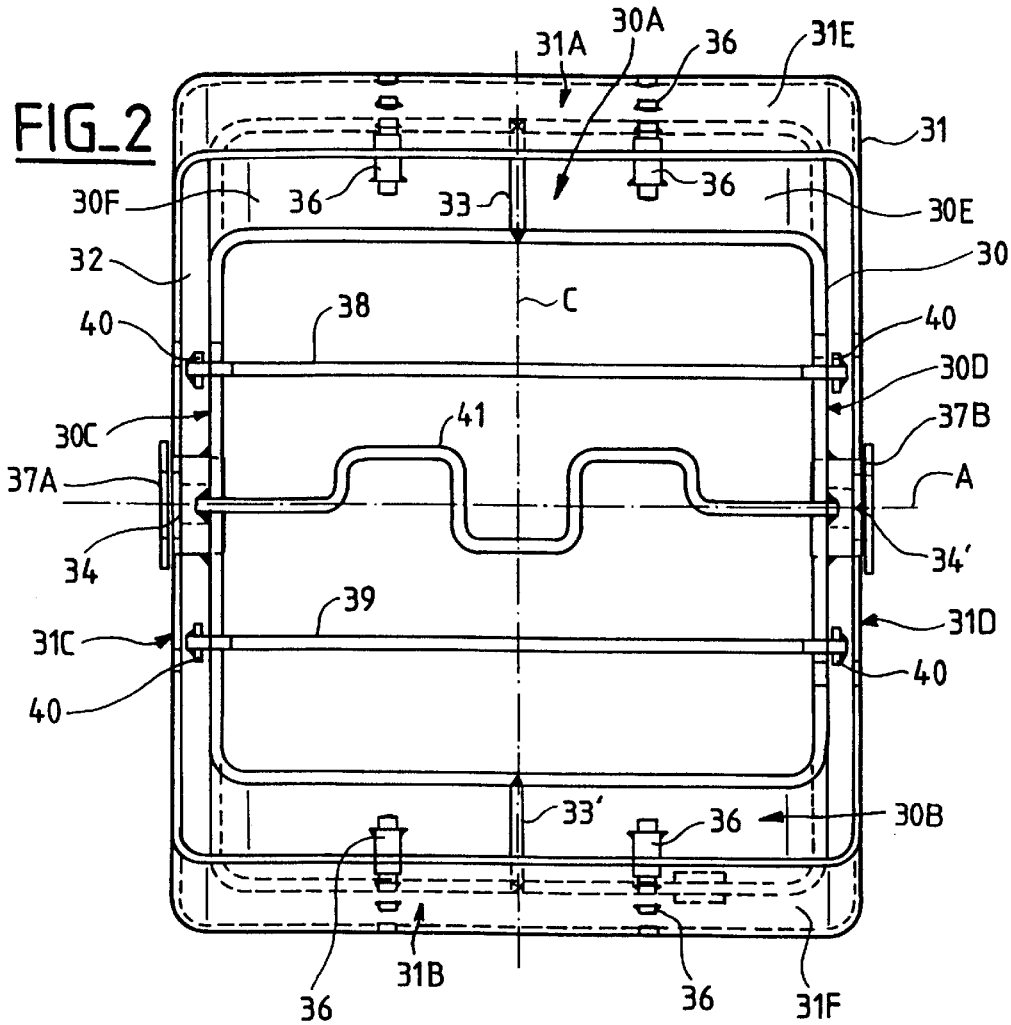
FIG. 2 is a diagrammatic front view of a nozzle in accordance with the invention.
Figure 3:
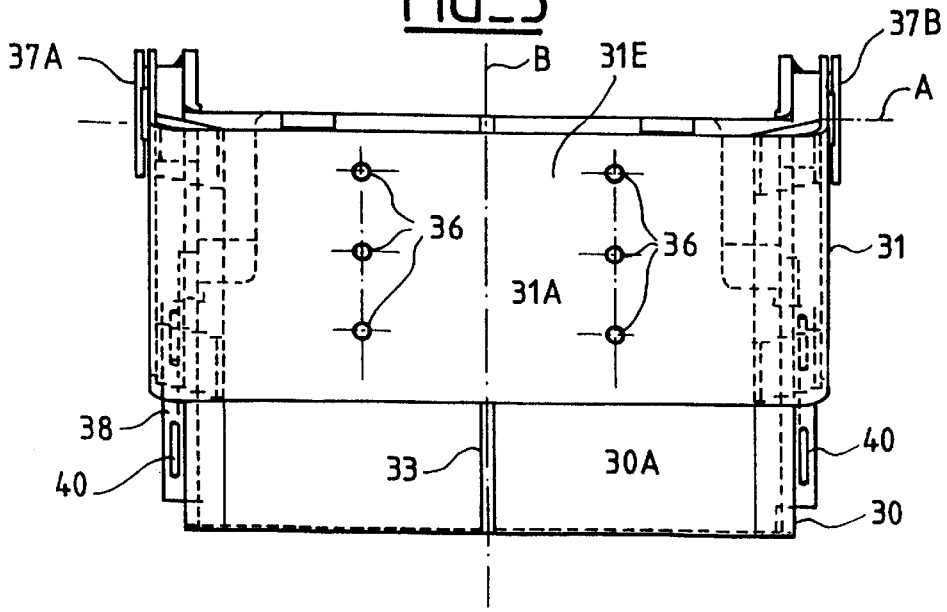
FIG. 3 is a diagrammatic top view of a nozzle in accordance with the invention.

FIGS. 2 and 3 show the welded or nested plate design of a nozzle in accordance with the invention for injecting pulverized coal, such as the nozzles 11, 11' in FIG. 1. As mentioned above, a nozzle of this kind is articulated to the body of a pulverized coal burner so that it can be inclined toward the top or toward the bottom of the combustion chamber of the boiler. The rotation axis A is shown in FIGS. 2 and 3 and its position is shown at 11A, 11'A in FIG. 1.

The aimable nozzle in accordance with the invention includes a prism-shaped first metal housing 30 with a rectangular base, truncated parallel to its base and having a top face 30A, a bottom face 30B and two lateral faces 30C, 30D. The housing 30 channels the flow of primary air mixed with pulverized coal.

The nozzle also includes a prism-shaped second metal housing 31 with a rectangular base, truncated parallel to its base, surrounding the first housing 30 coaxially and defining therewith an annular space 32 through which a flow of secondary air passes. The second housing has a top face 31A, a bottom face 31B and two lateral faces 31C, 31D. The faces 30C, 30D, 31C and 31D are parallel to each other. The angle of the prism forming the second housing can be slightly less than the angle of the prism forming the first housing so that the annular space widens in the direction from the rear of the nozzle (indicated by AR in FIG. 1) toward the front of the nozzle (indicated by AV in FIG. 1) from which the airflows exit. Moreover, as shown in FIG. 3, the second housing 31 is shallower in the direction of the longitudinal axis B than the first housing 30 to encourage cooling of the front of the latter by the secondary airflow.

Each of the two housings 30 and 31 is made up of two half-shells made of refractory steel plate that has been bent to shape. The housing 30 is made up of two half-shells 30E and 30F each of which has a substantially U-shaped cross section on the axis B and which are assembled by two continuous penetrating welds 33, 33' on the faces 30A, 30B of the housing 30. These welds lie in a median plane parallel to the faces 30C, 30D of the housing 30 and passing through the axis B.

The housing 31 consists of two half-shells 31E and 31F made of refractory steel plate that has been bent to shape and which each have a substantially U-shaped cross section on the axis B and are assembled by two continuous penetrating welds 34, 34' on the faces 31C, 31D of the housing 31. These welds lie in a median plane perpendicular to the faces 30C, 30D of the housing 30 and passing through the axis A.

This design of the housing of the nozzle eliminates fillet welds which cause many problems of mechanical strength when exposed to thermal stress.

The two housings 30 and 31 are fixed together by fixing lugs 36 welded to the faces 30A and 30B of the housing 30 and to the faces 31A, 31B of the housing 31, inside the annular space 32. These lugs are disposed in two rows of three parallel to the axis B on the faces 30A and 30B of the housing 30, as shown in FIG. 3. It is preferable for the rows of lugs 36 to be near the median vertical axis C of the nozzle to enable relative displacement of the lateral faces 30C, 30D relative to the lateral faces 31C, 31D caused by thermal stresses.

The nozzle further includes two pivots 37A and 37B for rotation about the axis A perpendicular to said lateral faces of the first housing, here the axis A. The pivots 37A and 37B are welded to the faces 30C and 30D of the housing 30 to the rear of the nozzle and pass without contact through the housing 31 by means of orifices therein to enable relative movement of the lateral faces of the housings 30 and 31 caused by thermal stresses.

The interior of the housing 30 is divided by parallel refractory steel splitter plates 38, 39 perpendicular to the faces 30C and 30D. These plates guide the pulverized coal into the combustion chamber when the nozzle is inclined relative to a horizontal position. According to the invention, the splitter plates 38 and 39 are fixed to the lateral faces 30C and 30D of the housing 30 by nesting their ends in openings provided in the lateral faces. The ends of the plates pass through said openings and receive immobilizing keys 40. The immobilizing keys are in the form of wedges forced into holes at the end of the splitter plates, for example. They are disposed in the annular space 32, allowing each splitter plate some play in a direction perpendicular to the lateral faces 30C and 30D to enable them to accommodate differential expansion of the faces of the housing 30.

The central splitter plate 41, which extends along the rotation axis A, is fixed to the lateral faces 30C and 30D of the housing 30, by welding its ends thereto, to increase the rigidity of the nozzle without compromising its resistance to thermal stresses. However, the central splitter plate has a corrugated shape enabling it to accommodate expansion of the component parts of the nozzle without stressing the welds.

The construction of the nozzle in accordance with the invention contributes to increasing its mechanical resistance to thermal stresses by reducing the effects of deformation of its component parts. As a result the service life of a nozzle of this kind is increased compared to a refractory steel casting.

What is claimed is:

1. An aimable nozzle for injecting pulverized coal into the combustion chamber of a thermal power plant boiler, said nozzle including a first metal housing in the shape of a truncated prism having a top face, a bottom face and two lateral faces, a second metal housing in the shape of a truncated prism coaxially surrounding said first housing and defining therewith an annular space through which passes a flow of secondary air, and two pivots for rotation about an axis perpendicular to said lateral faces of said first housing, wherein said first housing channels a flow of primary air mixed with pulverized coal, said housings are fastened to each other and the interior of said first housing is divided by parallel refractory steel splitter plates perpendicular to said lateral faces of said first housing, and wherein:

said splitter plates are fixed to said lateral faces of said first housing by nesting their ends in openings provided in said lateral faces and the ends of said plates pass through said openings to receive immobilizing keys disposed in said annular space, allowing each splitter plate some play in a direction perpendicular to said lateral faces of said first housing;

said second housing is fixed to said first housing by lugs disposed on said top face and said bottom face of said first housing and in said space between said housings;

said first housing is made up of two half-shells made from refractory steel plate bent to shape and welded together in a median transverse plane parallel to said lateral faces of said first housing, and said second housing is made up of two half-shells made from refractory steel plate bent to shape and welded to each other in a median transverse plane perpendicular to said lateral faces of said first housing; and said pivots are welded to said lateral faces of said first housing and pass without contact through said second housing by means of orifices provided therein.

2. A nozzle as claimed in claim 1 further including a central splitter plate which extends along said rotation axis, has a corrugated shape and is fixed to said lateral faces of said first housing by welding its ends thereto.

* * * * *